United States Patent [19]

Covington

[11] 4,139,918

[45] Feb. 20, 1979

[54] LIGHTWEIGHT, DISPOSABLE TRANSPORTATION CASKET

[75] Inventor: William P. Covington, Burnsville, Minn.

[73] Assignee: National Car Rental System, Inc., Minneapolis, Minn.

[21] Appl. No.: 889,375

[22] Filed: Mar. 23, 1978

Related U.S. Application Data

[62] Division of Ser. No. 767,824, Feb. 11, 1977, Pat. No. 4,123,831.

[51] Int. Cl.[2] ..... A47C 19/00; A47C 23/00

[52] U.S. Cl. ..... 5/186 R; 5/345 R; 5/DIG. 1; 5/93 B; 27/28

[58] Field of Search ..... 5/82 R, 186 R, 327 R, 5/345 R; 108/56; 27/28; 297/441, 457

[56] References Cited

U.S. PATENT DOCUMENTS

| | | | |
|---|---|---|---|
| 2,607,103 | 8/1952 | Davidson | 5/82 R |
| 3,487,479 | 1/1970 | Grooms | 5/93 R |
| 3,871,726 | 3/1975 | Stegner | 5/DIG. 1 |
| 3,913,154 | 10/1975 | Sweeney | 5/186 R |

*Primary Examiner*—Casmir A. Nunberg

*Attorney, Agent, or Firm*—Shoemaker and Mattare, Ltd.

[57] ABSTRACT

A lightweight, disposable transportation casket, including a shell section with a cover releasably attached thereto by securing straps. Mattress sections are supported inside the shell on a liner and the remains rest on the mattress sections. The sides of the container cover form a skirt and flare outwardly to form a handgrip by which the casket can be lifted. The remains are wrapped in a cover and rest on the mattress sections, and are held in place by straps. A headrest maintains the head in the desired position, and indicia on the cover identifies the head end of the casket.

2 Claims, 10 Drawing Figures

LIGHTWEIGHT, DISPOSABLE TRANSPORTATION CASKET

This is a division of application Ser. No. 767,824, filed Feb. 11, 1977, now U.S. Pat. No. 4,123,831.

BACKGROUND OF THE INVENTION

The present invention relates in general to containers, and, more particularly, to shipping containers.

As society becomes more and more mobile, family members often find themselves widely dispersed. Although geographically separated, many families prefer to be interred together. Therefore, when a family member passes away, the family often desires to transport the remains back to a central burial site.

Transporting remains from one location to another has therefore become a very large industry.

There are many problems inherent in such transportation, and one such problem is the cost thereof. One cost factor is connected with the shipping casket itself. Caskets formed of wood are often expensive because of labor costs. Such caskets are also heavy, bulky, and present many problems to a carrier. For these reasons, transporting remains from one location to another can be very expensive. With other costs involved in funerals being very high, transportation costs should be kept as low as possible, so that the average person can afford to move the remains of the family member back to a central, or family, burial site, and still give that family member a decent funeral.

Often, carriers have very strict specifications which must be met by such containers, and such specifications are often subject to change. The known containers often just barely meet the minimum standards, and are not amenable to changing to meet changed specifications.

The container embodying the teachings of the present invention is easily manufactured, transported, is lightweight and is fully and easily disposable.

SUMMARY OF THE INVENTION

The disposable transportation casket embodying the present invention is easily manufactured, transported and is fully disposable.

The container includes a shell section formed from an integral blank. The shell includes side flaps which are folded over side panels to trap locking tongues therebetween. Securing straps are attached to the inside surface of the base of the shell and extend through holes in the side panels.

Remains securing straps are also attached to the inside surface of the shell base and encircle the remains to secure them to the container. A liner is also formed from a blank and is located inside the shell. The remains, themselves, are wrapped in a wrapper of plastic-type material.

A plurality of mattress sections, preferably three, are each formed from integral blanks and are each positioned inside of the shell on the liner to support the remains. The sections bear against each other and against the shell to support the remains in a desired presentation.

A headrest is formed from a integral blank and rests on one of the mattress sections. The head is supported and maintained in the desired position and orientation by the headrest.

A cover is formed from an integral blank and includes side flaps which are folded over side panels. Struts extend transversely of the cover to support the cover and to hold the flaps in the folded orientation.

The flaps and panels of the cover form a skirt which depends from the cover and encircles the shell. The skirt is inclined with respect to the shell and defines a gap at the lower terminal edge thereof between that skirt and the shell. The gap enables the skirt to form a handhold by which the container can be lifted.

The securing straps encircle the container cover and thus lock that cover onto the shell. The entire container can thus be lifted using the handhold. Indicia are placed on one end of the container cover to indicate the position of the head.

All of the blanks are one-piece integral constructions, and therefore there are no seams to weaken the overall structure. This is especially important with regard to the shell and cover elements.

The construction of the container permits stresses to be evenly distributed, and, as the remains are supported by the cover via the securing straps, the shell section need not be constructed of the heavy structural materials heretofore used in such containers. The overall weight of the container is therefore lower than that of present containers.

Furthermore, because of the handgrip, the container embodying the teachings of the present invention does not have any protruding handles or sharp edges. Such sharp edges and/or handles can damage vehicles.

The container has a triple bottom and the sides are double and thus the container is very strong, while still being lightweight.

The container is easily manufactured and thus can be formed to conform to airline specifications, and even easily modified to meet changing specifications.

Furthermore, indicia marking the head end is subtle and, as the container is not distinctively shaped or otherwise marked, the container is easily disposed of, and is very unobtrusive in use.

The container, itself, can be shipped in knocked-down form, and quickly set up for use. Thus, many containers can be shipped and stored, thus further reducing costs inherent in such containers. It is even possible to ship hundreds of such containers to a disaster site in a single truck. Such a result is not possible with present containers.

OBJECTS OF THE INVENTION

It is therefore a main object of the present invention to provide a lightweight transportation casket.

Another object of the present invention is to provide a fully disposable transportation casket.

A further object of the present invention is to provide an easily assembled transportation casket.

It is yet another object of the present invention to provide a transportation casket which has no protruding handles or sharp edges.

It is yet a further object of the present invention to provide a transportation casket which meets or exceeds all carrier specifications.

It is still another object of the present invention to provide a transportation casket which is unobtrusive.

These together with other objects and advantages which will become subsequently apparent reside in the details of construction and operation as more fully hereinafter described and claimed, reference being had to the accompanying drawings forming part hereof, wherein like reference numerals refer to like parts throughout.

DETAILED DESCRIPTION OF THE INVENTION

Figure 1:
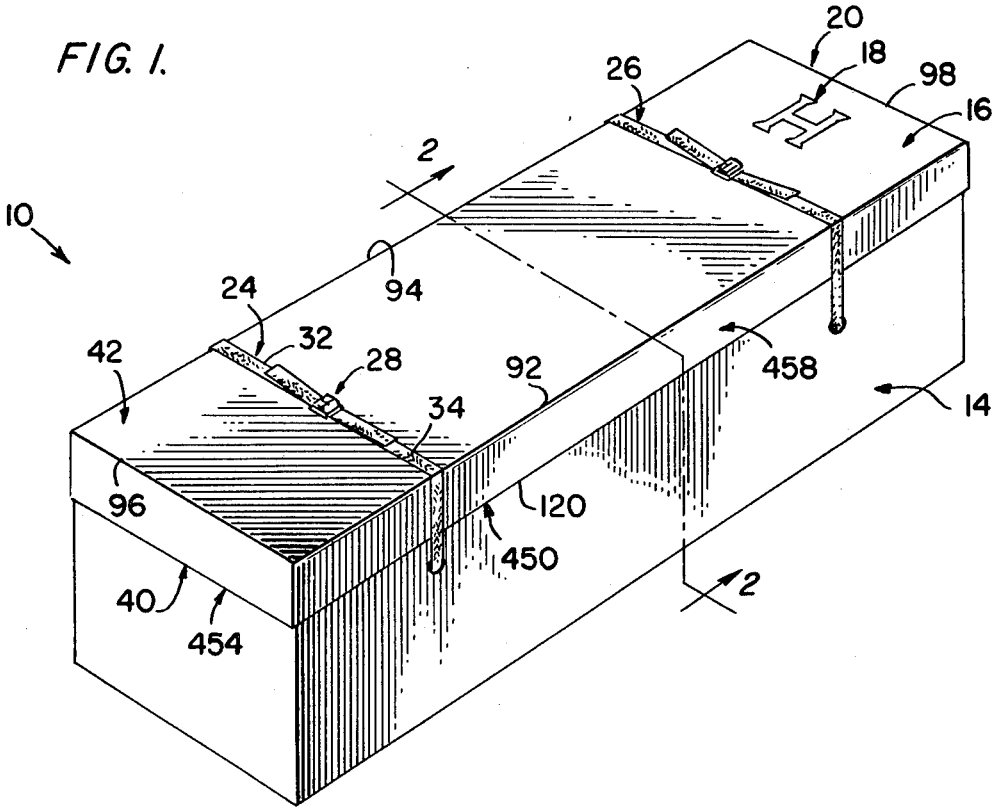
FIG. 1 is a perspective view showing the disposable transportation casket embodying the teachings of the present invention.

Shown in FIG. 1 is a disposable transportation casket, hereafter referred to as container 10, which embodies the teachings of the present invention, and includes a bottom shell 14 and a cover 16 having indicia 18 at head end 20 thereof and being coupled to the shell by securing straps 24 and 26. The securing straps have non-slip cinch buckles 28 thereon for coupling the strap sections, such as sections 32 and 34, together. As will be later discussed, the cover has a skirt section encircling the shell which forms a handgrip 40 by which the container can be elevated and moved. Indicia 18 distinguishes the container head end from the container foot end 42.

Figure 2:
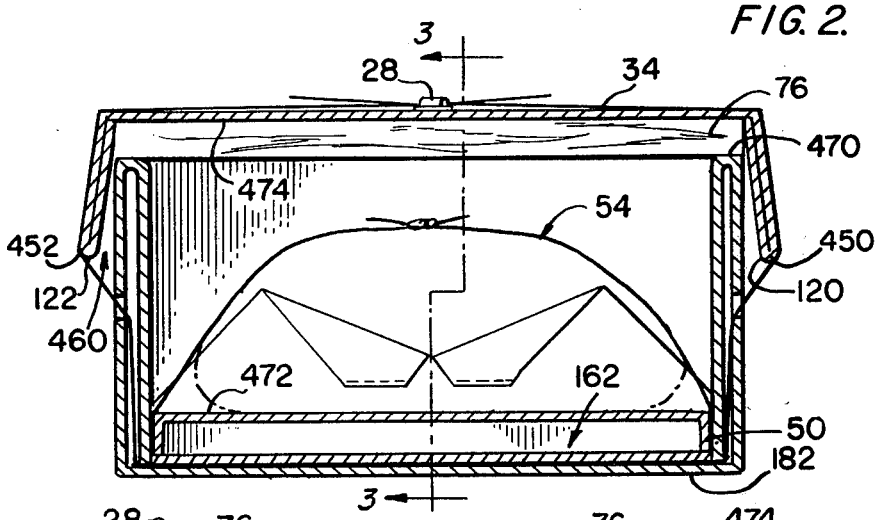
FIG. 2 is an end elevation view taken along line 2—2 of FIG. 1.
Figure 3:
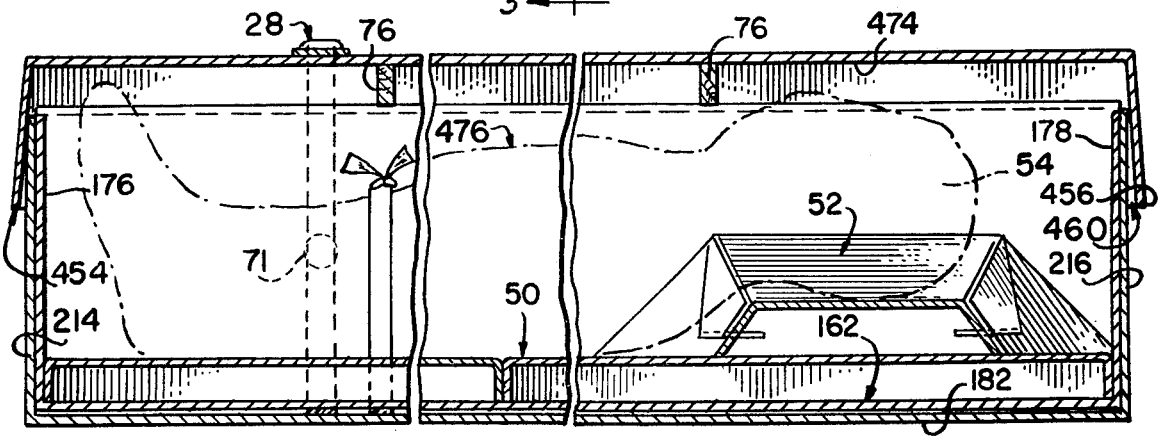
FIG. 3 is a side elevation view taken along line 3—3 of FIG. 2.
Figure 4:
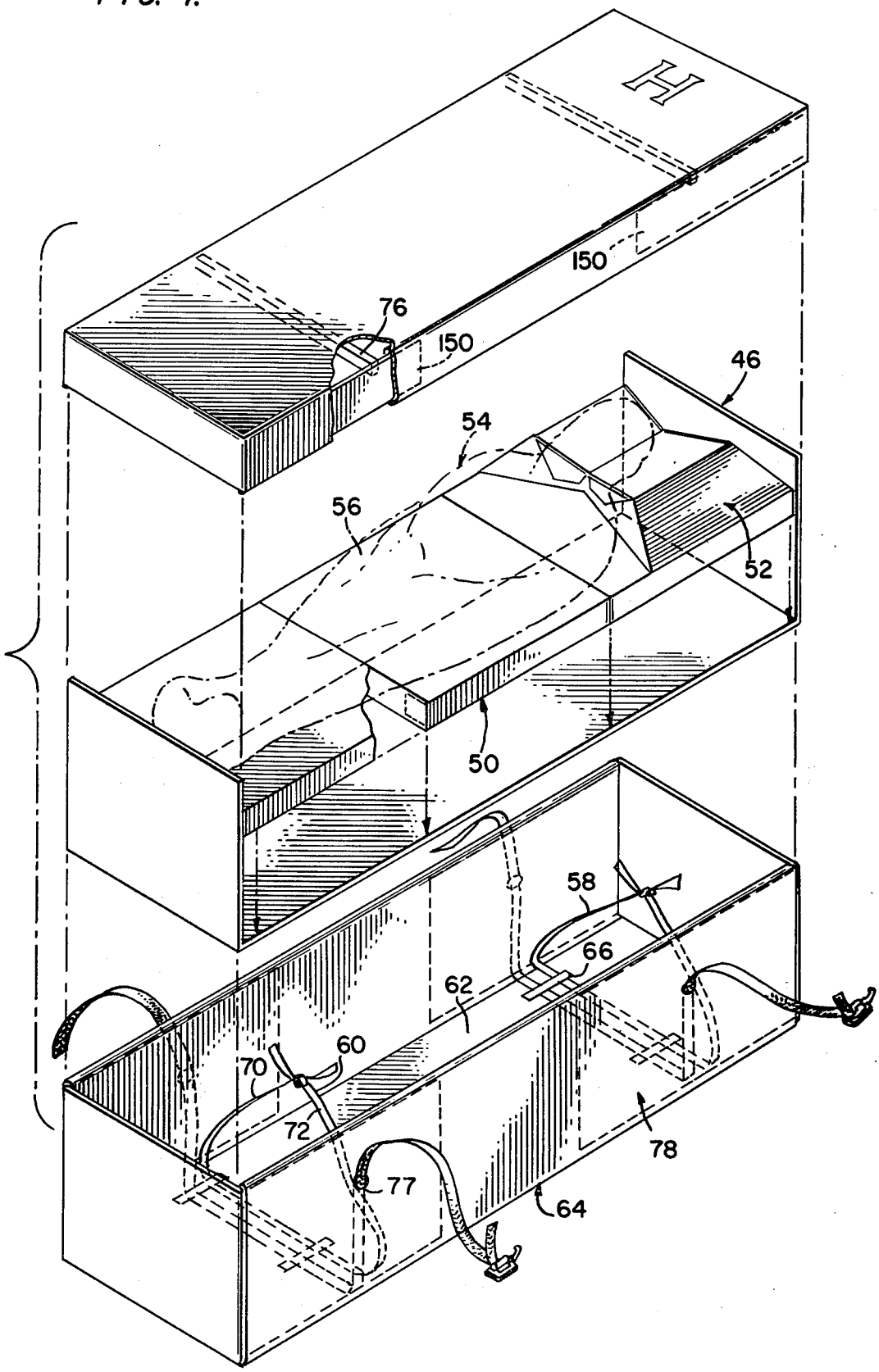
FIG. 4 is an exploded perspective of the disposable transportation casket embodying the teachings of the present invention.

As is best shown in FIGS. 2–4, the container houses an inner liner 46 upon which rests a plurality of mattress sections 50 and a headrest 52 for properly supporting remains 54, which are wrapped in a leakproof cover 56 and which are encircled by a chest strap 58 and a foot strap 60 connected to inner surface 62 of bottom shell base 64 by fasteners, such as tape 66. The straps each have connectible segments, such as segments 70 and 72, which can be coupled together by any suitable method, such as tieing or the like.

Struts 76 are located in the cover 16 and entry holes 77 are defined in sides 78 of the bottom shell. The securing straps are threaded through the entry holes, and the tape 66 also attaches the securing straps to the surface 62. The straps thus attach the remains to the container, and the securing straps interconnect the container shell and the cover and can be used as further handholds.

Figure 5:
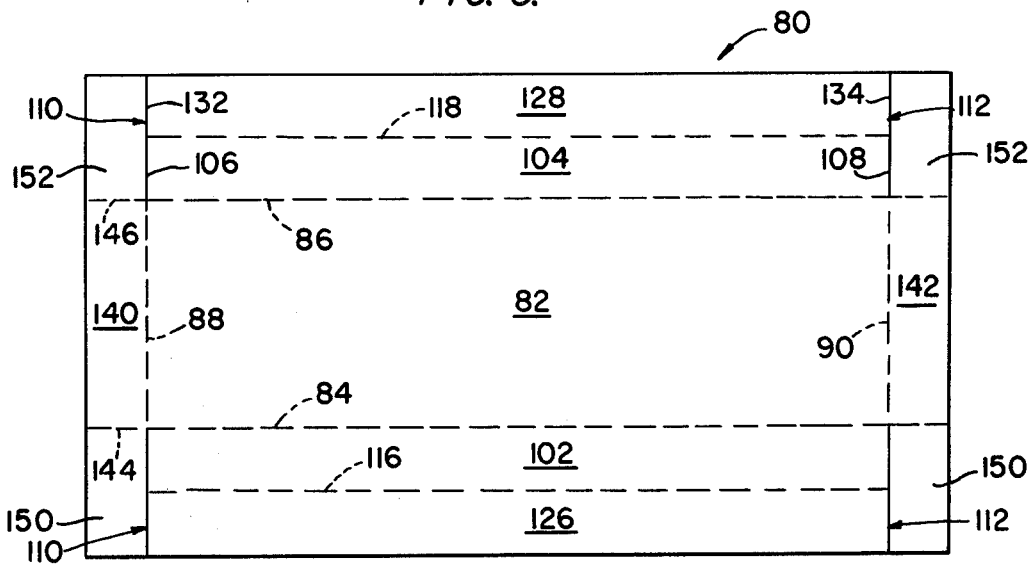
FIG. 5 is a plan view of a blank used to form the cover of the transportation casket embodying the teachings of the present invention.

Blanks used to form the elements of container 10 are shown in FIGS. 5–9. FIG. 5 shows a cover forming blank 80 used to form cover 16. The blank 80 is integral and includes a central rectangular panel 82 bonded by side fold lines 84 and 86 and end fold lines 88 and 90 which form lateral edges 92 and 94, and end edges 96 and 98, respectively, of the cover 16 in the set-up condition shown in FIG. 1. Integrally and foldably connected to the central panel 82 by the side fold lines are side panels 102 and 104 which form outer side panels of the set up cover. The side panels are rectangular and have ends such as ends 106 and 108 which are defined by cut lines 110 and 112, respectively. The fold lines 84 and 86 define one lateral edge of each of the side panels and fold lines 116 and 118, respectively, define the other lateral edges of the side panels. The fold lines 116 and 118 define under edges 120 and 122 of the set up cover, as shown in FIG. 2.

Integrally and foldably attached to the side panels by the fold lines 116 and 118 are side flaps 126 and 128 which are rectangular and connected to the flaps along one side edge thereof. The other side edges of each of the flaps each defines part of a marginal peripheral edge of the blank, and cut lines 110 and 112, respectively, define the two end edges 132 and 134 of the flaps.

Rectangular end flaps 140 and 142 are each oriented transversely of the central panel and are each integrally and foldably connected to the central panel by end fold lines 88 and 90, respectively, while being separated from the side panels and flaps by the cut lines 110 and 112, respectively. Break lines 144 and 146 are defined in each end flap to extend transversely of the end flaps and are co-linear with fold lines 84 and 86 to define insert tabs 150 and 152 which are interposed and trapped between the side flaps and the side panels in the set up cover, as shown in FIG. 4.

In the set-up configuration, the side flaps and the side panels are superposed and depend downwardly (i.e., toward base 64) 90° from central panel 82. The end flaps also depend downwardly from the central panel 82 and insert tabs 150 and 152 are co-planar with the side edge defining fold lines 84 and 86 and are interposed and trapped between the side flaps and panels to lock the end flaps into set-up configuration.

Figure 6:
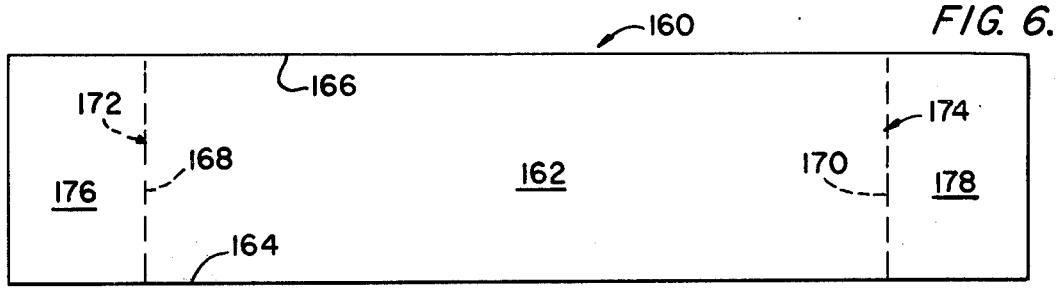
FIG. 6 is a plan view of a blank used to form the liner used in conjunction with a disposable casket embodying the teachings of the present invention.

An inner liner forming blank 160 is shown in FIG. 6 to be integral and to include a rectangular cross panel 162 having side edges 164 and 166 and end edges 168 and 170, with the end edges being defined by transverse fold lines 172 and 174, respectively. End panels 176 and 178 are rectangular and oriented to be transverse of the cross panel. The end panels have side edges, of one which is formed by a fold line, and the other of which defines the outer peripheral end edge of the liner blank 160. The longitudinal dimension of the cross panel 162 is essentially equal to the transverse dimension of shell base 64. The end flaps are folded upwardly 90° (i.e., to extend away from the base 64), and the thus set-up liner is inserted into the shell as shown in FIG. 4.

Figure 7:
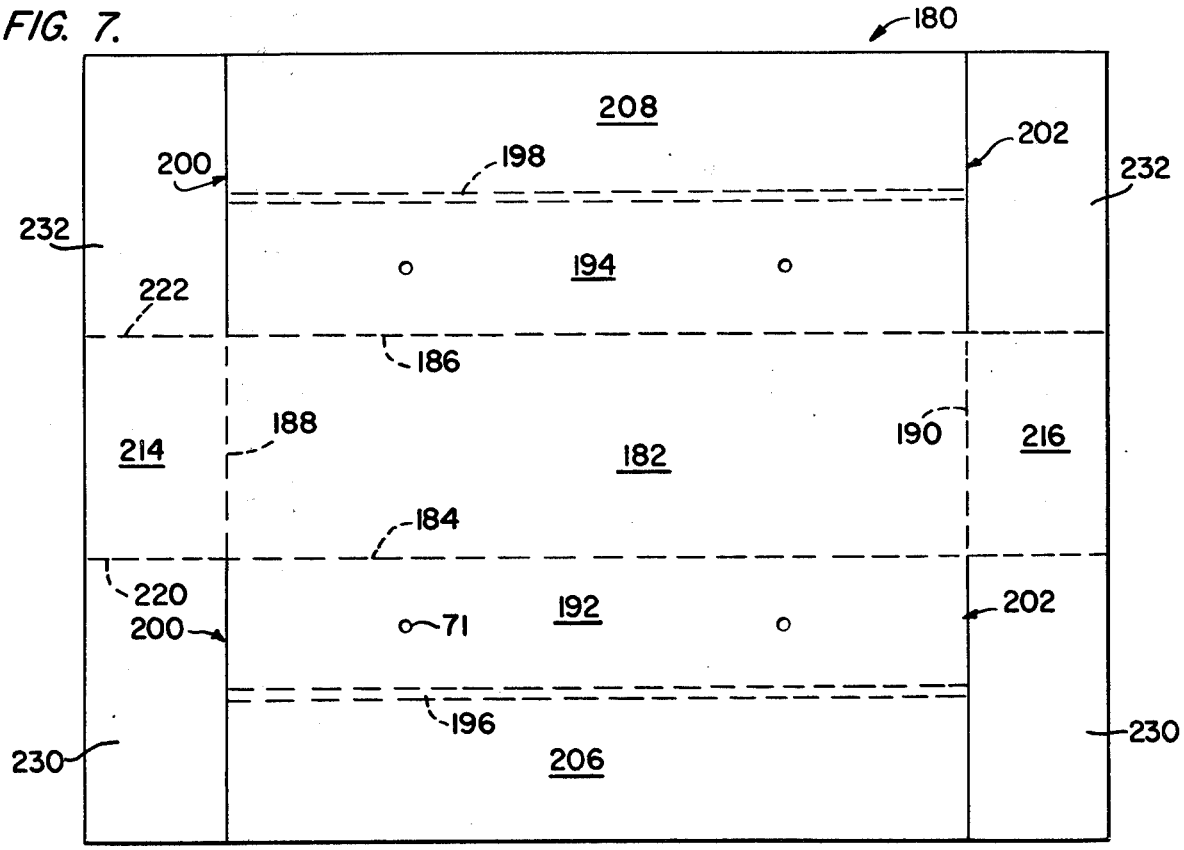
FIG. 7 is a plan view of a blank used to form a shell section of a disposable transportation casket embodying the teachings of the present invention.

The container shell 14 is formed from an integral shell forming blank 180 shown in FIG. 7 to include a rectangular base or central panel 182 bounded by side fold lines 184 and 186 and end fold lines 188 and 190. Integrally and foldably attached along one side thereof to the central panel by the fold lines 184 and 186 are rectangular shell side panels 192 and 194, respectively. The other sides of each of the shell side panels are formed by thick fold lines 196 and 198, respectively, and the shell side panel end edges are defined by cut lines 200 and 202, respectively. Integrally and foldably attached along one side thereof to the shell side panels by the thick fold lines are rectangular shell side flaps 206 and 208. The other side of each side flap forms part of the peripheral edge of the blank 180. The ends of the shell side flaps are defined by the cut lines 200 and 202.

End flaps 214 and 216 are rectangular and have the longitudinal dimension thereof oriented transversely of the base panel. The end flaps each have one side attached integrally and foldably to the base panel ends by the fold lines 188 and 190 and have the other side forming part of the peripheral edge of the blank 180. The ends of the end flaps are formed by fold lines 220 and 222 which are co-linear with fold lines 184 and 186, respectively.

Rectangular insert tongues 230 and 232 are foldably and integrally attached at one end thereof to the end flaps by fold lines 220 and 222, respectively. The other ends of the tongues form part of the side edge of the blank periphery and the other side of the tongues forms part of the inner edge of the blank periphery.

As shown in FIG. 7, longitudinally spaced apart securing strap access holes 71 are defined in the side flaps.

In setting up the shell, the shell side panels are rotated 90° about fold lines 184 and 186 to be upright (i.e., extending upwardly from the base surface 62) with respect to the central panel, the end flaps are similarly rotated about fold lines 188 and 190 to be upright with respect to the central panel with the insert tongues on the inside of the side panels to be co-planar with one of the side edges forming fold lines 184 or 186 (i.e., inside of the set-up shell). The shell side flaps are then rotated 90° with respect to the shell side panels about the thick fold lines to be located inside the tongues. Thus, the tongues are interposed between and trapped by the superposed shell side panels and side flaps, thereby locking the completed shell in the set-up configuration, as best shown in FIG. 4. The thick fold lines have a transverse dimension essentially equal to the thickness of the tongues so the aforementioned overfolding can be accomplished.

The securing straps are thus trapped between the panels and tongues to be held in place.

Figure 10:
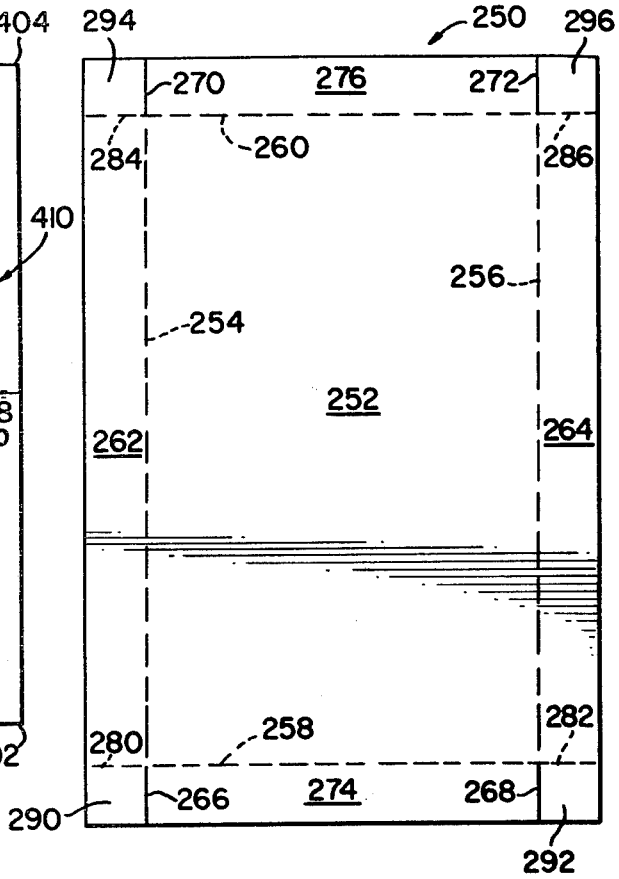
FIG. 10 is a plan view of a blank used to form a mattress section used in conjunction with a disposable transportation casket embodying the teachings of the present invention.
Figure 9:
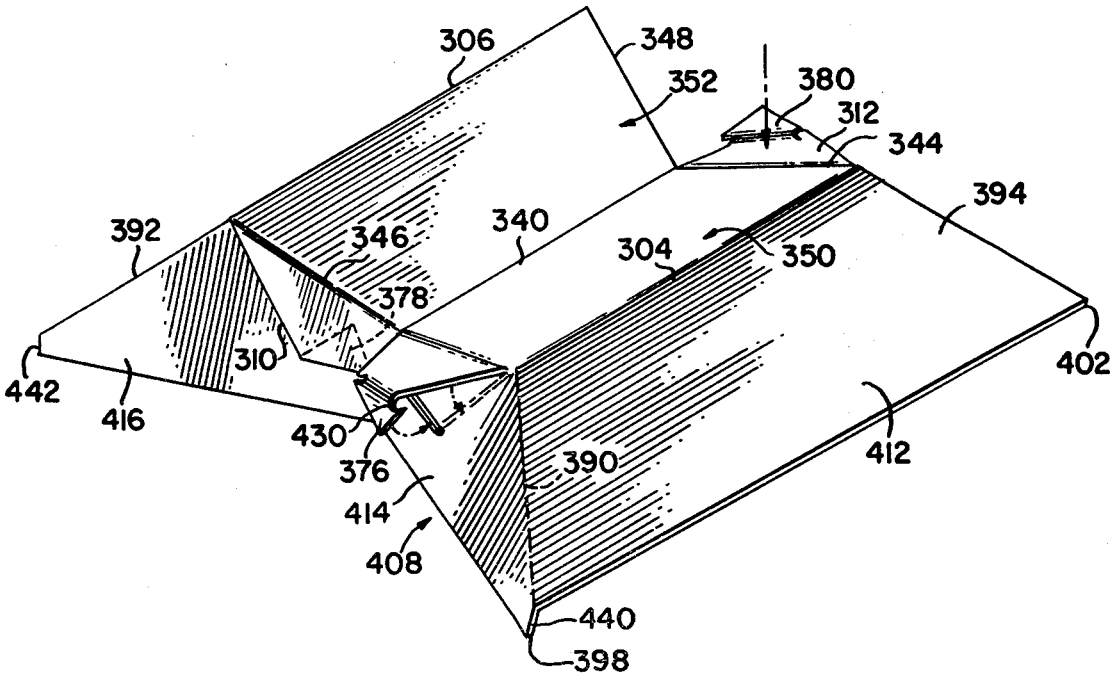
FIG. 9 is a perspective of a partially set up headrest used in conjunction with a disposable transportation casket embodying the teachings of the present invention.

A mattress section blank is integral and is identified in FIG. 10 by the numeral 250, and includes a rectangular central panel 252 bounded by side edge fold lines 254 and 256 and end edge fold lines 258 and 260. Rectangular side flaps 262 and 264 are foldably and integrally attached at one side edge thereof to the central panel by the fold lines 254 and 256, respectively. Cut lines 266, 268, 270 and 272 are co-linear with the central panel side edge defining 254 and 256 and define opposite ends of rectangular end flaps 274 and 276, each of which has one side edge thereof integrally and foldably attached to the end edges of the central panel by fold lines 258 and 260 and the other side edge thereof forming part of the peripheral end edge of the blank 250. Further fold lines 280 and 282 are co-linear with the fold line 258, and fold lines 284 and 286 are co-linear with the fold line 260. The fold lines 280 through 286, along with the cut lines, define insert tabs 290, 292, 294 and 296 which are foldably and integrally attached to the side flaps by the fold lines 280–286.

Set up of the mattress section is effected by rotating the side flaps 90° with respect to the central panel to depend downward (i.e., toward the base 64) from that central panel, rotating the tabs 90° inward to be co-planar with end edge forming fold lines 258 and 260 (i.e., toward the central panel) to form a corner, then folding the end flaps 90° with respect to the central panel to depend therefrom. The inner surface of the end flap thus contacts one surface of the insert tabs, and if desired, adhesive can be placed on the contacting surfaces to attach those surfaces together. The outer edges of the flaps thus form a rim which contacts surface 62 and upon which the mattress section rests when that surface is positioned on top of surface 62 as shown in FIGS. 2 and 3.

In the preferred embodiment, there are three mattress sections; however, more or less can be used as desired. The remains rest upon the mattress sections as shown in FIG. 2.

When the mattress sections are inserted into the container, the outer surfaces of each of the end flaps abuts the inner surface of the shell side flaps and the mattress section side flaps abut each other and the inner surface of the liner flaps, as shown in FIG. 4. In this manner, the mattress sections are supported and thus have enough strength to properly support the remains 54 in the position shown in FIGS. 2 and 3.

Figure 8:
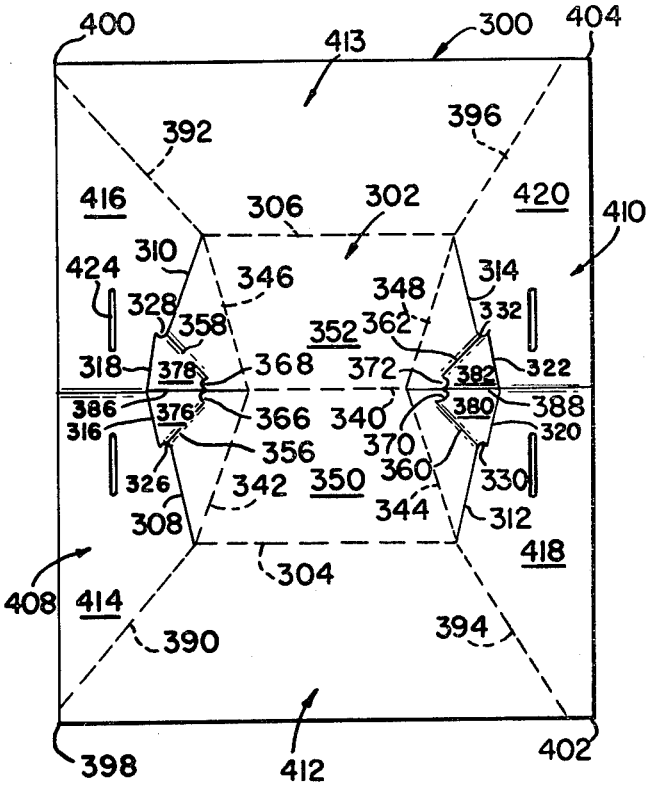
FIG. 8 is a plan view of a blank used to form a headrest used in conjunction with a disposable transportation casket embodying the teachings of the present invention.

The headrest 52 is formed from a rectangular integral headrest blank 300 shown in FIG. 8. A central polygonal panel 302 is defined by transverse crease lines 304 and 306, inclined cut lines 308, 310, 312 and 314, diverging cut lines 316, 318 and 320, 322 and arcuate cuts 326, 328, 330 and 332 which interconnect one end of the divergent cut lines to one end of the inclined cut lines, with the other end of each of the inclined cut lines contacting one end of the horizontal crease lines. A transverse crease line 340 is in spaced parallelism with the crease lines 304 and 306 and extends across blank 300. Inclined crease lines 342, 344, and 346, 348 extend from the intersection of the inclined cut lines and the crease lines 304 and 306 and intersect each other at crease line 340 to define a pair of diamond-shaped end flaps on the central panel 302, and a pair of trapezoidal-shaped side sections 350 and 352 are defined by the crease lines 340, 342 and 344, 346, 348.

Inclined crease lines 356, 358 and 360, 362 each intersect at one end thereof a corresponding one of the inclined cut lines 308–314 at the intersection of that cut line and the arcuate cuts and extend toward crease line 340. The other end of each of the inclined crease lines 356–362 is spaced from the crease line 340 and these ends are connected thereto by arcuate cuts 366, 368, 370 and 372.

The arcuate cuts and the inclined cut lines form a plurality of arrowhead-shaped tongues 376, 378 and 380 and 382. The arrowhead tongues are formed to be in pairs of adjacent pairs with adjacent tongues of the pairs being separated from each other by transverse cut lines 386 and 388 which are co-linear with crease line 340 and each extends from one end thereof to the intersection of the inclined cut lines 316, 318 and 320, 322. The inclined crease lines 356–362 foldably and integrally connect the arrowhead tongues to the end flaps.

A plurality of inclined fold lines 390, 392, 394 and 396 are each formed by a line of weakening in the blank and each extends from a peripheral edge of the blank 300 toward the central panel 302. The fold lines 390–396 intersect the blank peripheral edges at locations spaced from the corners 398, 400, 402 and 404 thereof, thus defining side panels 408 and 410 and end panels 412 and 413 which are each in the form of an irregular pentagon. Crease line 340 extends across the blank and transversely bisects the side panels 408 and 410 to form side panel sections 414, 416 and 418, 420. Each of the sections 414–420 has an elongate arrowhead receiving slot 424 defined therein.

As can be seen in FIG. 8, cut lines 316–322 intersect to form corners of the central panel, and crease lines 342–348 intersect fold lines 304 and 306 at the intersection of those fold lines and cut lines 308–314 to form other corners of the central panel. The central crease line 340 intersects the corners of the central panel which include the cut lines 316–322.

Set up of the headrest is effected by rotating the side panels downward about the crease lines 340 and 390–396, while rotating the trapezoidal side sections 350 and 352 downward (i.e., toward surface 62). The arrowhead tongues are placed on top of the side panel sections and inserted downwardly through the arrowhead receiving slots to lock the headrest into the head receiving and securing configuration. Flared lips 430 on the rear end (i.e., that end closest to fold lines 342–348) lock the arrowhead tongue into the slots, while the inclination of cut lines defining the tongues are selected to enable easy insertion thereof into the slots while insuring a secure lock after such insertion.

The set-up headrest is then placed on top of the mattress section adjacent the container head end, as shown in FIG. 4, to receive remains 54. The offset of the fold lines 390–396 produces corner stop lips 440 and 442 which abut the inner corners of the container 10 to insure that the headrest remains in position once so placed.

With reference to FIGS. 1, 2, 3 and 4, it is seen that the container top is slightly larger than the container shell. Thus, lower peripheral edges 450, 452, 454 and 456 of the shell skirt section 458 are spaced apart from the shell. This spacing defines a gap 460 as shown in FIGS. 2 and 3, and produces the handgrip 40 by which the container can be lifted and moved.

The securing straps encircle the cover and the remains as shown in FIGS. 2–4, thus when the container is lifted by either the handgrip or the securing straps, the lifting force is applied to the remains and the shell is merely carried along. The mattress sections and liner keep the straps trapped against the shell, and the straps are attached to the shell by being trapped between the shell side panels and side flaps, and the tape secures the straps to the shell. Thus, the straps are attached to the shell in a secure manner. The lifting force is also resisted by the mattress sections jammed together and against the shell.

Thus, the stresses involved in lifting the container are mainly taken up by the cover with the remainder being distributed among the other container elements. Therefore, the remains, in essence, are supported from the container.

As shown in FIG. 2, the struts 76 extend across the container and rest on the upper rim 470 of the shell. The struts serve several purposes. Not only do the struts reinforce the cover, but they serve as spacers to adjust the overall height of the container, as well as the clearance between the top surface 472 of the in-place mattress sections and the bottom surface 474 of the in-place cover section. Thus, the struts placed as shown in FIG. 2 set one height and clearance, while providing two side-on-side struts raises the cover at that position. Thus, remains having a large midsection can be accommodated by adding further struts to the strut superjacent the midsection 476 shown in FIG. 3 to raise the cover accordingly, in which case the cover would be tilted downward toward the base from the foot section to the head section.

The struts also serve to keep the cover properly folded once that cover is set up. If height adjustment, and support are not needed, the struts can be omitted to reduce the weight of the container.

Preferably, the container is 7 feet by 2 feet by 2feet when set up, and is formed of reinforced fiberboard with a bursting strength of 600 psi which is treated to resist moisture and humidity. The support straps are preferably 600 psi polypropylene, and the foot and chest straps are preferably nylon.

As this invention may be embodied in several forms without departing from the spirit or essential characteristics thereof, the present embodiment is, therefore, illustrative and not restrictive, since the scope of the invention is defined by the appended claims rather than by the description preceding them, and all changes that fall within the metes and bounds of the claims or that form their functional as well as conjointly cooperative equivalents are, therefore, intended to be embraced by those claims.

I claim:

1. An integral foldable mattress forming blank for use in a transportation casket comprising:

a rectangular central panel having four right angle corners;

a pair of rectangular end flaps each foldably connected along one side edge thereof to one end edge of said central panel and having the end edges thereof essentially colinear with the central panel side edges so that said end flaps are connected along an entire end edge of said central panel from corner to corner thereon, another side edge of each of said end flaps forming a portion of an outer end edge of the blank;

a pair of rectangular side flaps each foldably connected along one side edge thereof to one side edge of said central panel, said foldable connection between said side flaps and said central panel extending for essentially the entire length of said central panel side edge from corner to corner on said side edge, another side edge of each of said side flaps forming a portion of an outer side edge of the said blank; and each side flap having an insert tab foldably connected thereto at each end thereof, said insert tabs each having a first edge contacting but separated from end edges of said end flaps by a cut line, a second edge aligned with said flap another side edge to be colinear therewith, a third edge defined by said foldable connection between said insert tab and said side flap, and a fourth edge aligned with said another side edge with said end flaps to be colinear therewith, said insert tab second and fourth edges each forming portions of the blank outer perimeter and intersecting each other at right angles so that the blank outer perimeter is essentially rectangular.

2. An integral mattress section for use in a transportation casket comprising:

a rectangular central panel having four right angle corners;

a pair of rectangular end flaps each connected along one side edge thereof to one end edge of said central panel and depending downwardly therefrom so that said end flaps are connected along an entire end edge of said central panel from corner to corner, another side edge of each of said end flaps extending downward from said one end edge and forming a lower end edge of the mattress section;

a pair of rectangular side flaps each connected at one side edge thereof to one side edge of said central panel and depending downwardly therefrom, said side flaps each having another side edge extending downward from said one side edge and forming a lower side edge of the mattress section;

rectangular insert tabs connected at one end edge thereof to an end edge of each of said side flaps and positioned to have side edges thereof essentially coplanar with said end flap side edges and with an end edge of said central panel and to have one surface contacting an inner surface of one of said end flaps, said insert tabs each having one side edge parallel to and adjoining one of said end flap another side edges to form a part of the lower end edge of the mattress section.

* * * * *